US008261571B2

(12) United States Patent
Tian et al.

(10) Patent No.: US 8,261,571 B2
(45) Date of Patent: Sep. 11, 2012

(54) MULTIFUNCTIONAL VENTILATING FAN

(75) Inventors: Liang Tian, Guangdong (CN); Kai Tan, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 562 days.

(21) Appl. No.: 12/497,157

(22) Filed: Jul. 2, 2009

(65) Prior Publication Data

US 2010/0000711 A1 Jan. 7, 2010

(30) Foreign Application Priority Data

Jul. 7, 2008 (CN) ..... 2008 1 0135636

(51) Int. Cl.
*F25D 17/06* (2006.01)

(52) U.S. Cl. ..... 62/411; 62/419

(58) Field of Classification Search ..... 62/411, 62/419, 412, 414, 314, 187; 454/333, 341; 165/59, 121; 137/216.2, 217
See application file for complete search history.

(56) References Cited

U.S. PATENT DOCUMENTS

| | | | | |
|---|---|---|---|---|
| 3,878,886 | A * | 4/1975 | McIntire, Jr. | 165/59 |
| 3,977,466 | A * | 8/1976 | Johansson | 165/285 |
| 4,048,811 | A * | 9/1977 | Ito et al. | 62/263 |
| 4,490,596 | A * | 12/1984 | Hirai et al. | 219/623 |
| 6,032,478 | A * | 3/2000 | Da Luz Moreas | 62/262 |
| 6,790,012 | B2 * | 9/2004 | Sharp et al. | 417/201 |
| 6,978,635 | B2 * | 12/2005 | Yabu et al. | 62/271 |
| 7,073,566 | B2 * | 7/2006 | Lagace et al. | 165/8 |
| 7,082,781 | B2 * | 8/2006 | Kikuchi et al. | 62/271 |
| 2004/0129011 | A1 * | 7/2004 | Kikuchi et al. | 62/271 |
| 2004/0134210 | A1 * | 7/2004 | Yabu et al. | 62/271 |
| 2005/0115269 | A1 * | 6/2005 | Ozaki et al. | 62/470 |
| 2006/0196195 | A1 * | 9/2006 | Ikegami et al. | 62/94 |
| 2007/0209385 | A1 * | 9/2007 | Yabu et al. | 62/480 |
| 2008/0017347 | A1 * | 1/2008 | Chung et al. | 165/4 |
| 2010/0039771 | A1 * | 2/2010 | Marchand | 361/694 |

FOREIGN PATENT DOCUMENTS

CN 261548 Y 5/2004

* cited by examiner

*Primary Examiner* — Mohammad Ali
(74) *Attorney, Agent, or Firm* — RatnerPrestia

(57) ABSTRACT

A multifunctional ventilating fan comprises a machine body, a panel provided with an air inlet and an air outlet. The machine body includes a first area, a second area, and a third area separated by several partition plates. The first area is provided with a first heat exchanger and a ventilating blower. A exhaust port of the ventilating blower is communicated with the outdoor. The second area is provided with a second heat exchanger and a circulating blower. The third area is provided with a compressor. The air inlet of the panel is communicated with the first area to form a first air path. The air inlet of the panel, the first area, the second area and the air outlet of the panel are communicated in turn to form a second air path. A first valve is provided in the second air path for isolating the first area so that a third air path is formed by the air inlet of the panel, the second area and the air outlet of the panel communicated in turn. The present invention can effect ventilating, dehumidifying, heating, cooling and the like functions.

12 Claims, 13 Drawing Sheets

MULTIFUNCTIONAL VENTILATING FAN

FIELD OF THE INVENTION

The present invention relates to a ventilating fan, and more particularly, to a multifunctional ventilating fan.

BACKGROUND OF THE INVENTION

Ventilating fans are common ventilation devices and are usually mounted on the wall or the ceiling of the room. A conventional multifunctional dehumidifier has been disclosed in a China patent published as CN2615548Y. As shown in FIG. 1, the main components of the multifunctional dehumidifier 10 are disposed in the same air path. An evaporator 4, a condenser 2, a tubular electric heating element 7, a blower 5, an indoor air outlet 6 and an outdoor air outlet 8 are provided in turn from the air inlet to the air outlet. An electric damper 9 is provided between the indoor air outlet 6 and the outdoor air outlet 8. A compressor 1 and a capillary tube 3 are positioned beside the air path. The compressor 1 is connected with the condenser 2 and the condenser 2 is connected to the evaporator 4 via the capillary tube 3.

For such a prior art multifunctional dehumidifier, since there is only one air path accommodating therein blades, the evaporator 4 and the condenser 2, the air absorbed by the blades can only pass through the evaporator 4 and the condenser 2 and thus just have dehumidifying, drying, ventilating and heating functions, but can not perform cooling.

SUMMARY OF THE INVENTION

To address one or more of the above problems and enhance other functions, the present invention provides a novel multifunctional ventilating fan, in which different components are disposed in different air paths so as to perform cooling function and meanwhile enhance other functions.

In order to achieve the above object, the present invention provides a multifunctional ventilating fan, comprising a machine body, a panel provided with an air inlet and an air outlet. The machine body includes a first area, a second area, and a third area separated by several partition plates; and wherein the first area is provided with a first heat exchanger and a ventilating blower, a exhaust port of the ventilating blower is communicated with the outdoor; the second area is provided with a second heat exchanger and a circulating blower; the third area is provided with a compressor; the air inlet of the panel is communicated with the first area to form a first air path; the air inlet of the panel, the first area, the second area and the air outlet of the panel are communicated in turn to form a second air path; a first valve is provided in the second air path for isolating the first area so that a third air path is formed by the air inlet of the panel, the second area and the air outlet of the panel communicated in turn.

The present invention can perform ventilating, dehumidifying, heating and cooling and the like functions:

Ventilating: when the first air path is communicated, the air is introduced from the air inlet of the panel, enters the first area of the machine body, and then is discharged to the outdoor by the ventilating blower communicated with the outdoor, so that the ventilating function is realized;

Dehumidifying: when the second air path is communicated, the first valve is in an open position, and when the first heat exchanger is used as an evaporator and the second heat exchanger is used as a condenser, the air is introduced from the air inlet of the panel, enters the evaporator as the first heat exchanger, by which the moisture in the air is condensed into liquid and extracted from the air, and then the air passes through the condenser as the second heat exchanger. After that, the air is blown out from the air outlet of the panel. At this time, the air is a dehumidified air, and thus the dehumidifying function is realized;

Heating: when the third air path is communicated, and the first heat exchanger is used as an evaporator and the second heat exchanger is used as a condenser, the air is introduced from the air inlet of the panel, and then enters directly into the condenser as the second heat exchanger without passing through the first area. That is, the air having introduced from the air inlet of the panel partly passes through the evaporator in the first area along the first air path, and partly passes through the condenser in the second area along the third path. At this time, if the condenser functions to heat, the air having passed through the third air path is heated and sent out from the air outlet of the panel, and thus the heating function is realized;

Cooling: when the third air path is communicated and the first heat exchanger is used as a condenser and the second heat exchanger is used as an evaporator, the air is introduced from the air inlet of the panel, and then enters directly into the evaporator as the second heat exchanger without passing through the first heat exchanger. That is, the air having introduced from the air inlet of the panel partly passes through the condenser in the first area along the first air path and partly passes through the evaporator in the second area along the third path. At this time, if the evaporator functions to cool, the air having passed through the third air path is cooled and sent out from the air outlet of the panel, and thus the cooling function is realized.

The panel with the air inlet and air outlet is mounted at a lower side or a lateral side of the machine body.

A second valve is provided at the exhaust port of the ventilating blower for blocking up the communication between the ventilating blower and the outdoor.

When the ventilating blower is turned off and only the circulating blower in the second area is operated, due to the drawing effect of the circulating blower in the second area, all the air introduced from the air inlet of the panel passes through the first area and enters the second area directly, and then is blown out from the air outlet of the panel. At this time, the dehumidifying effect is high.

When the exhaust port of the ventilating blower is closed so as to direct the air from the ventilating blower toward the second area and both the ventilating blower and the circulating blower are operated, the air introduced from the air inlet of the panel quickly passes the first area and enters the second area directly and then is blown out from the air outlet of the panel. With this configuration, because two blowers are used, more air can be obtained during the two heat exchanging processes, so that the heat exchange effect is better and thus the dehumidifying effect is much higher.

Further, a second valve is provided at the exhaust port of the ventilating blower for blocking up the communication between the ventilating blower and the outdoor so that the air from the ventilating blower is guided towards the air outlet of the panel to form a fourth air path. After the air introduced from the air inlet of the panel flows into the heat exchanger in the second area, the moisture in the air is extracted. Then, the air is blown toward the indoor via the air outlet of the panel. After the air introduced from the air inlet of the panel flows into the heat exchanger in the first area, the air is heated and then the air is blown toward the indoor via the air outlet of the panel. The above two kinds of air are mixed in the room and help to improve the dehumidifying effect.

The first valve consists of a first plate and a second plate which are openable or closable, wherein the first plate is positioned between the first heat exchanger and the second heat exchanger for blocking the air from the first heat exchanger from entering the second area when it is closed, and for allowing the air from the first heat exchanger to enter the second area when it is opened; the second plate is positioned between the first heat exchanger and the panel for blocking the air from the air inlet of the panel from directly entering the second area when it is closed, and for allowing the air from the air inlet of the panel from directly entering the second area when it is opened.

The first valve is a third plate sliding up and down along the partition plate between the first area and the second area; when the third plate slides upwardly, the air inlet of the panel, the second area and the air outlet of the panel are communicated to form the third air path; at the same time, the air inlet of the panel, the first area and the exhaust port of the ventilating blower are communicated to form the first air path; when the third plate slides downwardly, the air inlet of the panel, the first area, the second area and the air outlet of the panel are communicated to form the second air path.

The first heat exchanger is obliquely positioned in the first area with respect to the panel.

The first heat exchanger is perpendicularly positioned on the diagonal line of the first area with respect to the panel.

The panel is provided with a second air inlet directly communicated with the second area.

A scroll of the ventilating blower is positioned perpendicularly or transversely with respect to the panel.

The blades of the ventilating blower are multi-wing blades.

The circulating blower has cross flow blades or multi-wing blades.

The advantages of the present invention are that it can perform ventilating, dehumidifying, heating, cooling and the like functions.

BRIEF DESCRIPTION OF THE DRAWINGS

The embodiments of the present invention will be described with reference to the accompanying drawings.

DETAILED DESCRIPTION OF THE PREFERRED EMBODIMENTS

Figure 1A:
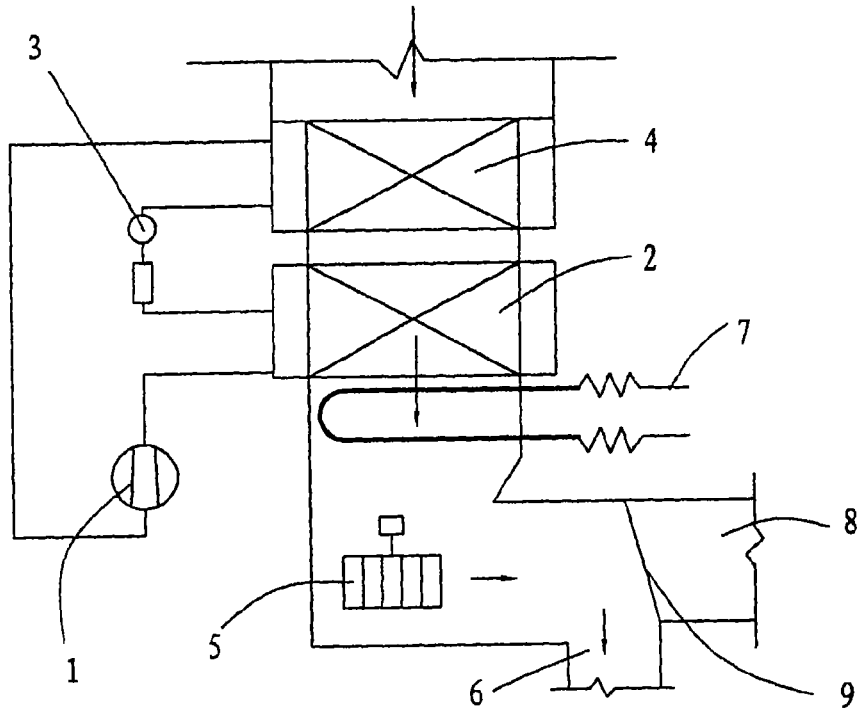
Fig. 1A Prior Art
FIGS. 1A and 1B schematically show the prior arts.
Figure 1B:
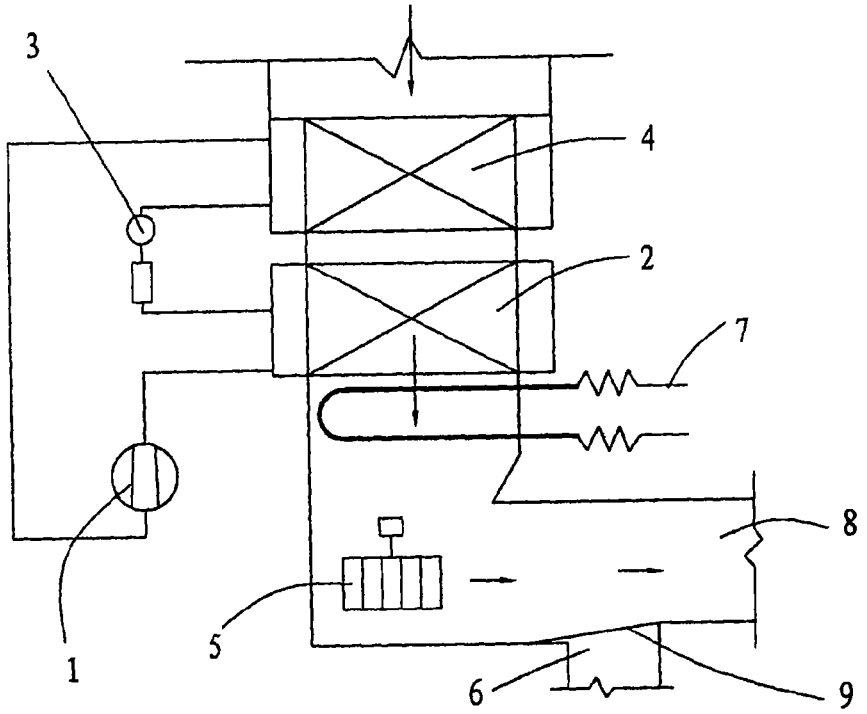
Fig. 1B Prior Art

The present invention will be described in detail with reference to the embodiments. The examples thereof are shown in the figures. Throughout the drawings, the same reference numerals designate the same elements or parts. The embodiment is described in conjunction with the drawings in order to explain the present invention FIGS. 2A, 2B, 2C, 2D, and 2E are schematic views of the first embodiment of the present invention. As shown in FIGS. 2A, 2B, 2C, 2D, and 2E, a multifunctional ventilating fan 1000 comprises a machine body 10, a panel 20 provided with an air inlet 21 and an air outlet 22, and a compressor 50 mounted in the machine body 10. The machine body 10 is divided into a first area 100, a second area 200, and a third area 300 defined and separated by a first partition plate 11, a second partition plate 12 and a third partition plate 13. The first area 100 is provided therein with a first heat exchanger 110 and a ventilating blower 120. A exhaust port 121 of the ventilating blower 120 is communicated with the outdoor. The second area 200 is provided therein with a second heat exchanger 210 and a circulating blower 220. The third area 300 is provided therein with a compressor 50.

According to the present embodiment, a first plate 410 is provided on the first partition plate 11; a second plate 420 is provided between the first partition plate 11 and the panel 20. The first plate 410 and the second plate 420 constitute a first valve. According to the present invention, the two plates 410 and 420 are controlled to be opened and closed so as to control the switching of the air paths in the machine.

Figure 2A:
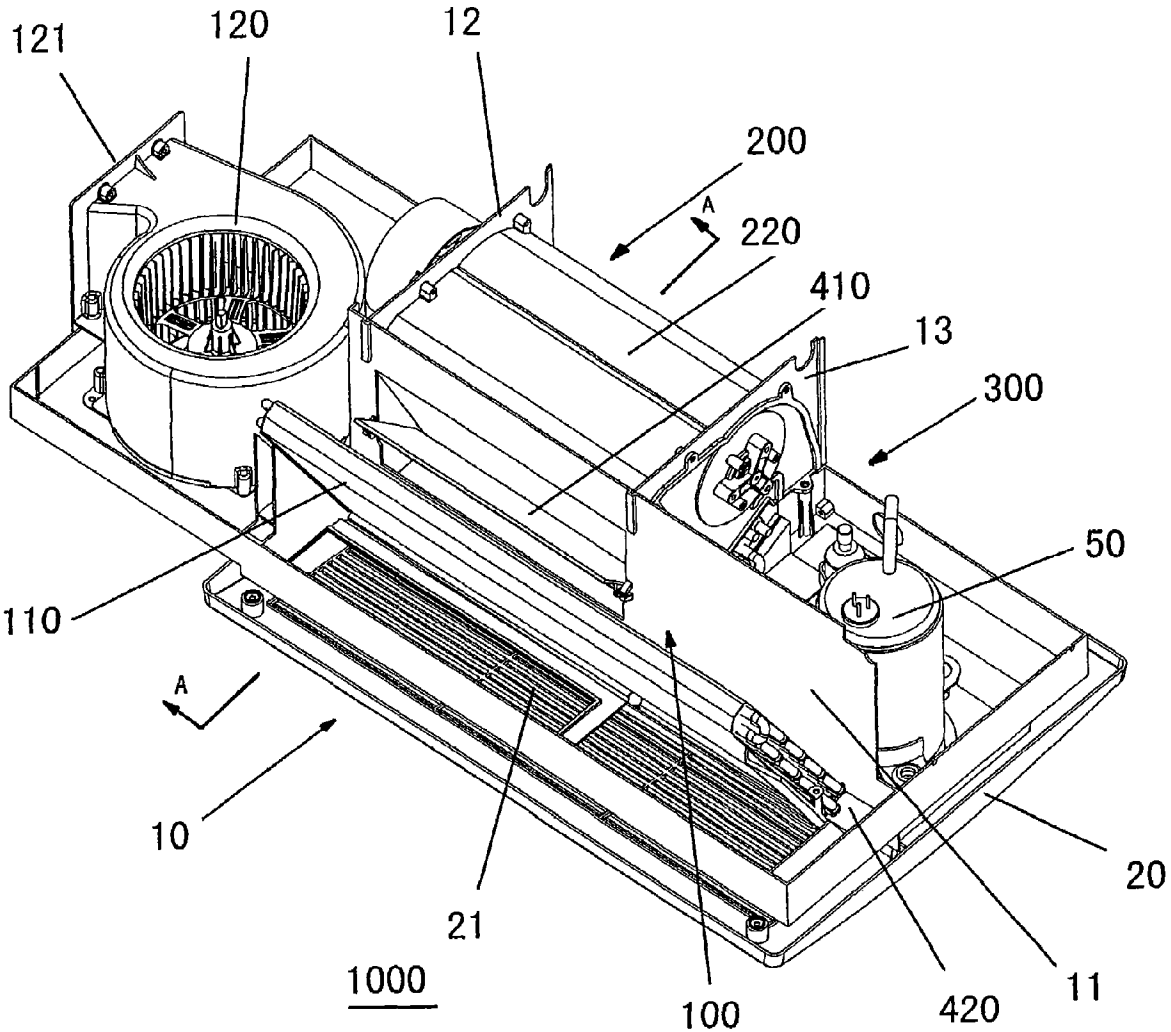
FIGS. 2A, 2B, 2C, 2D, and 2E are schematic views of the first embodiment of the present invention.
Figure 2B:
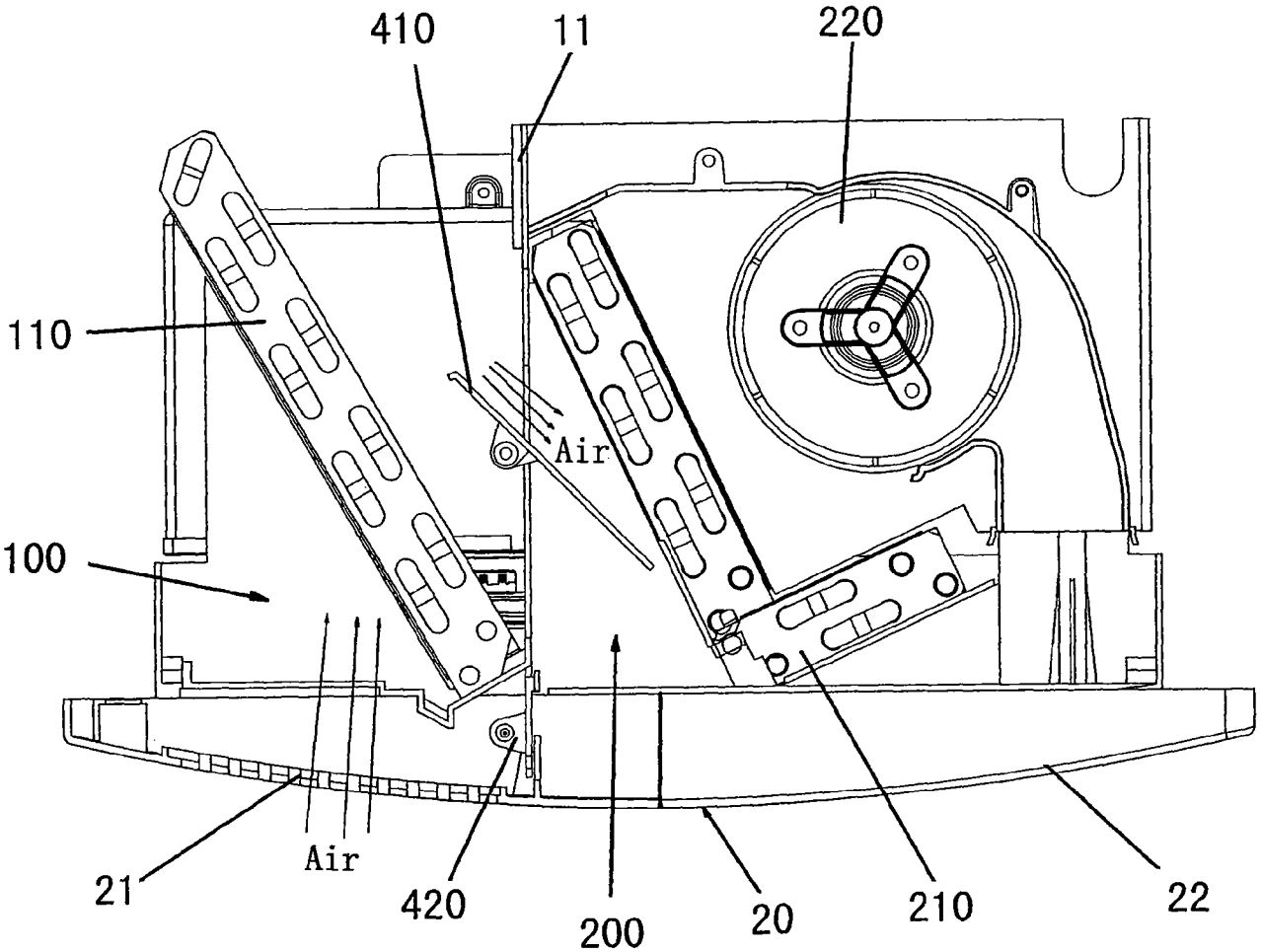

FIG. 2B is a sectional view along the line A-A in FIG. 2A. As shown in FIG. 2B, the first plate 410 on the first partition plate 11 is positioned between the first heat exchanger 110 and the second heat exchanger 210. In FIG. 2B, the first plate 410 is shown in an open position. At this time, the air from the first heat exchanger 110 can enter into the second area 200. The second plate 420 is positioned on the extended line of the first partition plate 11. The second plate 420 is shown in a close position in FIG. 2B. At this time, the air introduced from the air inlet 21 of the panel 20 can be blocked from directly entering into the second area 200 but must enter into the first area 100 at first.

Figure 2C:
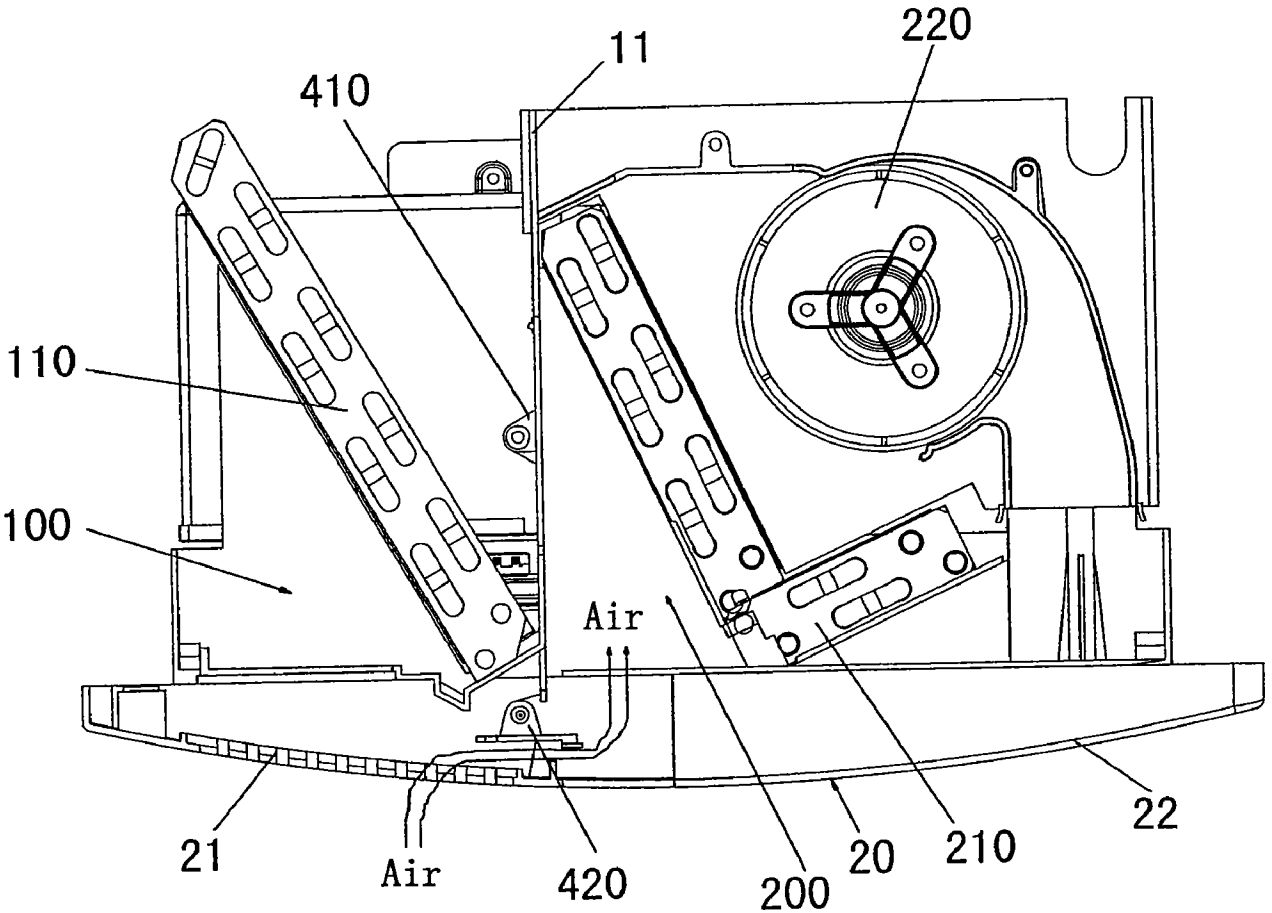

FIG. 2C is a schematic view showing a state in which the first plate 410 in FIG. 2B is closed and the second plate 420 in FIG. 2B is opened. As shown in FIG. 2C, when the first plate 410 is closed, the air passing through the first heat exchanger 110 can be blocked from entering into the second area 200, and when the second plate 420 is opened, the air introduced from the air inlet 21 of the panel 20 can be directed toward both of the first area 100 and the second area 200.

Again referring to FIG. 2B in which the first plate 410 is opened and the second plate 420 is closed, when the first heat exchanger 110 is used as an evaporator, and the second heat exchanger 210 is used as a condenser, if the circulating blower 220 is operated, the air is introduced from the air inlet 21 of the panel 20, and then firstly enters the evaporator as the first heat exchanger 110, by which the moisture in the air is condensed into liquid and is extracted from the air, and then the air passes through the condenser as the second heat exchanger 210. After that, the air is blown out from the air outlet 22 of the panel 20. This forms a second communicated air path. In that case, the air is dehumidified air. That is, the dehumidifying function is realized. If, at this time, the ventilating blower 120 as shown in FIG. 2A is also operated, since the first air path is formed to communicate with the outdoor via the exhaust port 121 of the ventilating blower 120 in the first area 100, the part of air entering the first area 100 from the air inlet 21 of the panel 20 is exhausted to the outdoor via the exhaust port 121 of the ventilating blower 120, so that the ventilating function is realized.

Referring again to FIG. 2C, the first plate 410 is closed and the second plate 420 is opened. When the circulating blower 220 is operated, the air is introduced from the air inlet 21 of the panel 20, and then passes through the condenser as the second heat exchanger 210, and then is blown out from the air outlet 22 of the panel. This forms a third communicated air path. If, at this time, the ventilating blower 120 as shown in FIG. 2A is also operated, the air also enters the first area 100 from the air inlet 21 of the panel 20, passes through the first heat exchanger 110, and then the air is discharged to the outdoor via the exhaust port 121 of the ventilating blower 120 communicated with the outdoor. This forms a first communicated air path and the ventilating function is realized at the same time.

In this regard, the heating function or the cooling function can be realized depending on the different arrangements of the first heat exchanger 110 and the second heat exchanger 210.

Specifically, if at this time the first heat exchanger is used as an evaporator, and the second heat exchanger is used as a condenser, then the air is heated and the warm air is blown out from the air outlet 22 of the panel. That is, the heating function is realized.

Instead, if at this time the first heat exchanger is used as a condenser and the second heat exchanger is used as an evaporator, then the air is cooled and the cold air is blown out from the air outlet 22 of the panel. That is, the cooling function is realized.

Figure 2D:
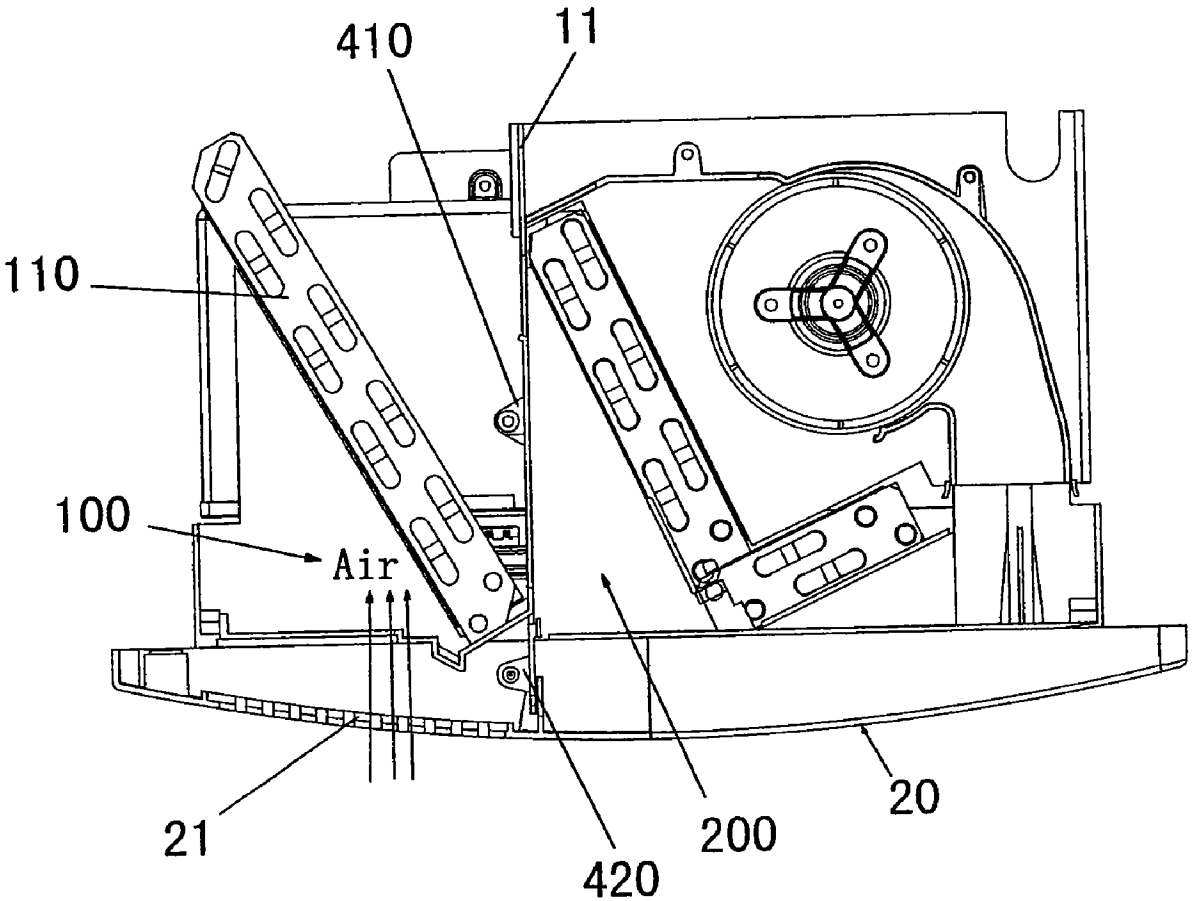
Figure 2E:
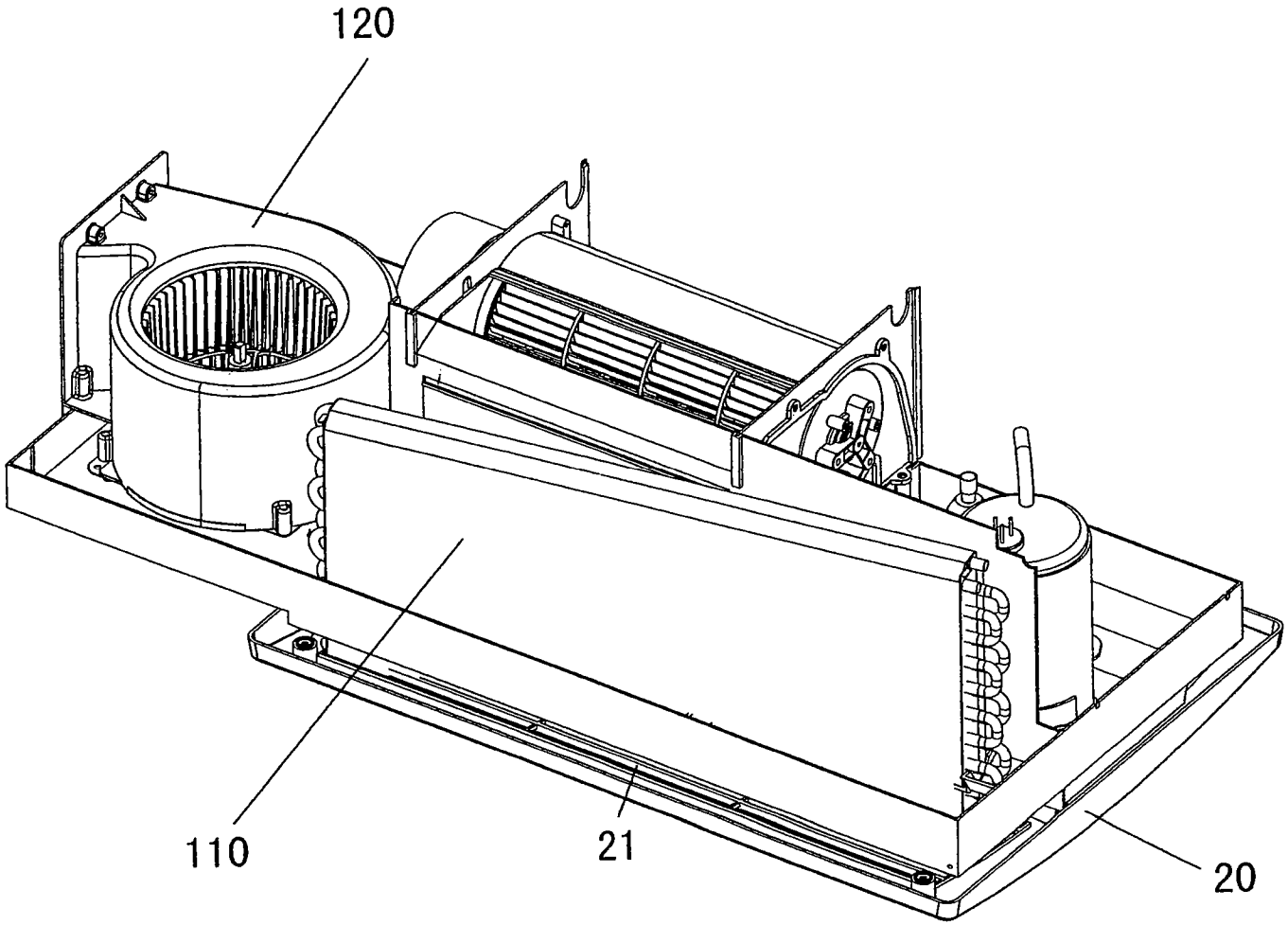

FIG. 2D is a schematic view showing a state in which the first plate 410 and the second plate 420 in FIG. 2B are both closed. At this condition, only the ventilating function is realized. Specifically, when the ventilating blower (not shown) is operated, the air is introduced from the air inlet 21 of the panel 20 and enters the first area 100. Then the air is discharged to the outdoor by the ventilating blower (now shown) communicated with the outdoor. This forms a first communicated air path and only the ventilating function is realized.

Referring again to FIG. 2A, a scroll of the ventilating blower 120 is disposed transversely, i.e. parallel to the plane of the panel 20 for the purpose of ensuring a thin product and maximizing the diameter of the blades so as to increase the amount of air. The scroll of the ventilating blower 10 may also be designed perpendicularly with respect to the panel 20. When it is disposed perpendicularly, the space for introducing air is much larger, and a larger amount of air can be obtained for the same blades and the same scroll.

In the present embodiment, the blades of the ventilating blower 120 are multi-wing blades, which have a larger static pressure and can produce a more stable air amount than the spiral blades. The circulating blower may have multi-wing blades or cross flow blades. The cross flow blades have a larger amount of air and an evenly distributed air flow rate, while the multi-wing blades have a larger pressure and produce a larger amount of air too.

In the present embodiment, the panel 20 is mounted at the lower side of the machine body. Of course, the panel 20 may also be mounted at a lateral side. In that way, the adaptability for mounting can be improved.

Referring again to FIG. 2A, the first heat exchanger 110 is obliquely disposed in the first area with respect to the panel 20. The advantage of the oblique arrangement is to take full use of the space of the product, increase the contact area between the air introduced from the air inlet 21 of the panel 20 and the first heat exchanger 110 so as to improve the heat exchange effect; On the other hand, additional advantage resides in a thinner product. Also, the first heat exchanger 110 may be disposed perpendicularly on the diagonal line of the first area 100 as shown in FIG. 2A with respect to the panel 20. The advantage of such a perpendicular arrangement and diagonal configuration is that because at a place near the ventilating blower 120, the air inlet is smaller and at a place far from the ventilating blower 120, the air inlet is larger, the perpendicular arrangement and diagonal configuration can make the air introduced from the air inlet 21 of the panel 20 pass through the first heat exchanger 110 more evenly and reduce the loss of air.

Figure 3A:
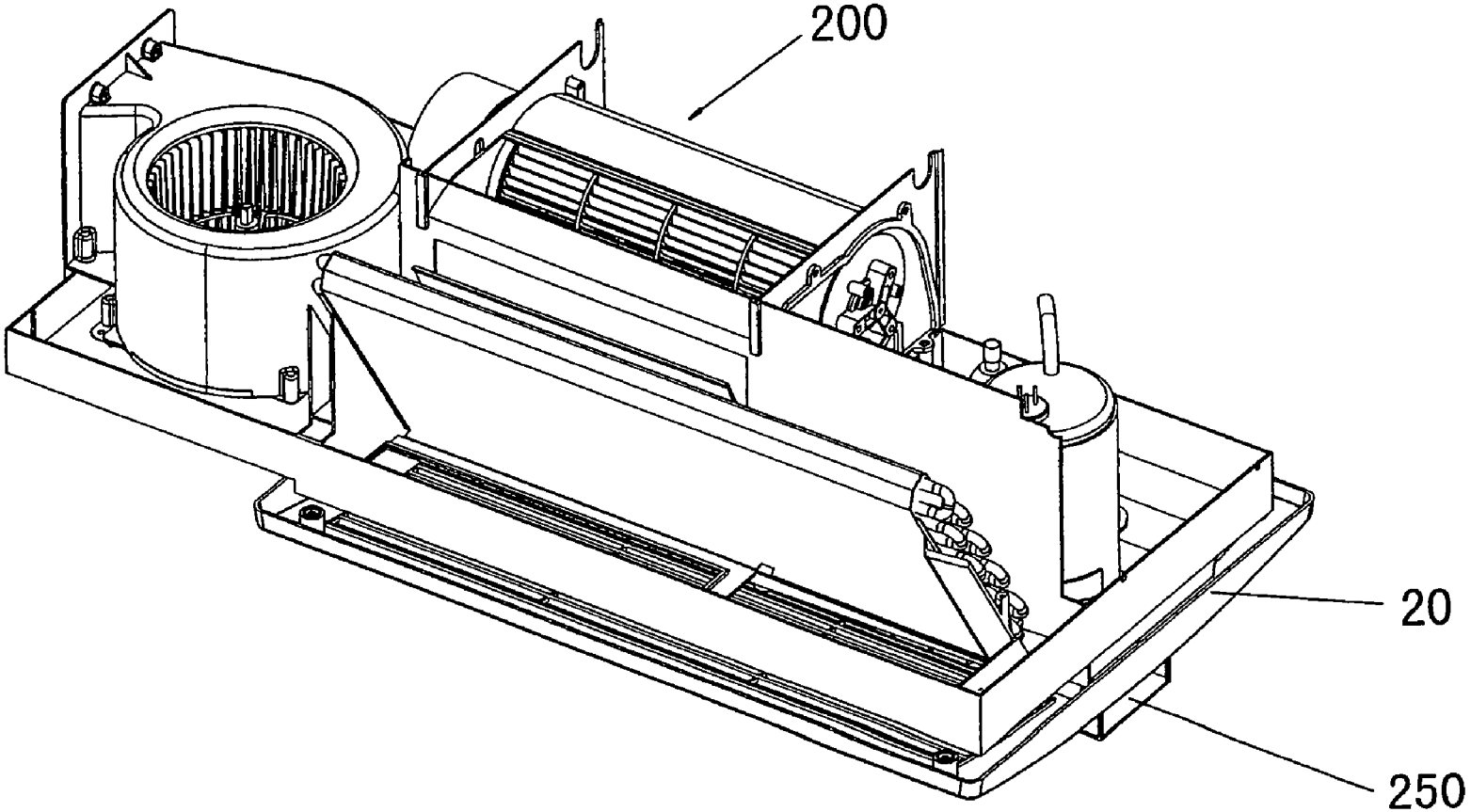
FIGS. 3A, 3B and 3C are schematic views of the second embodiment of the present invention.
Figure 3B:
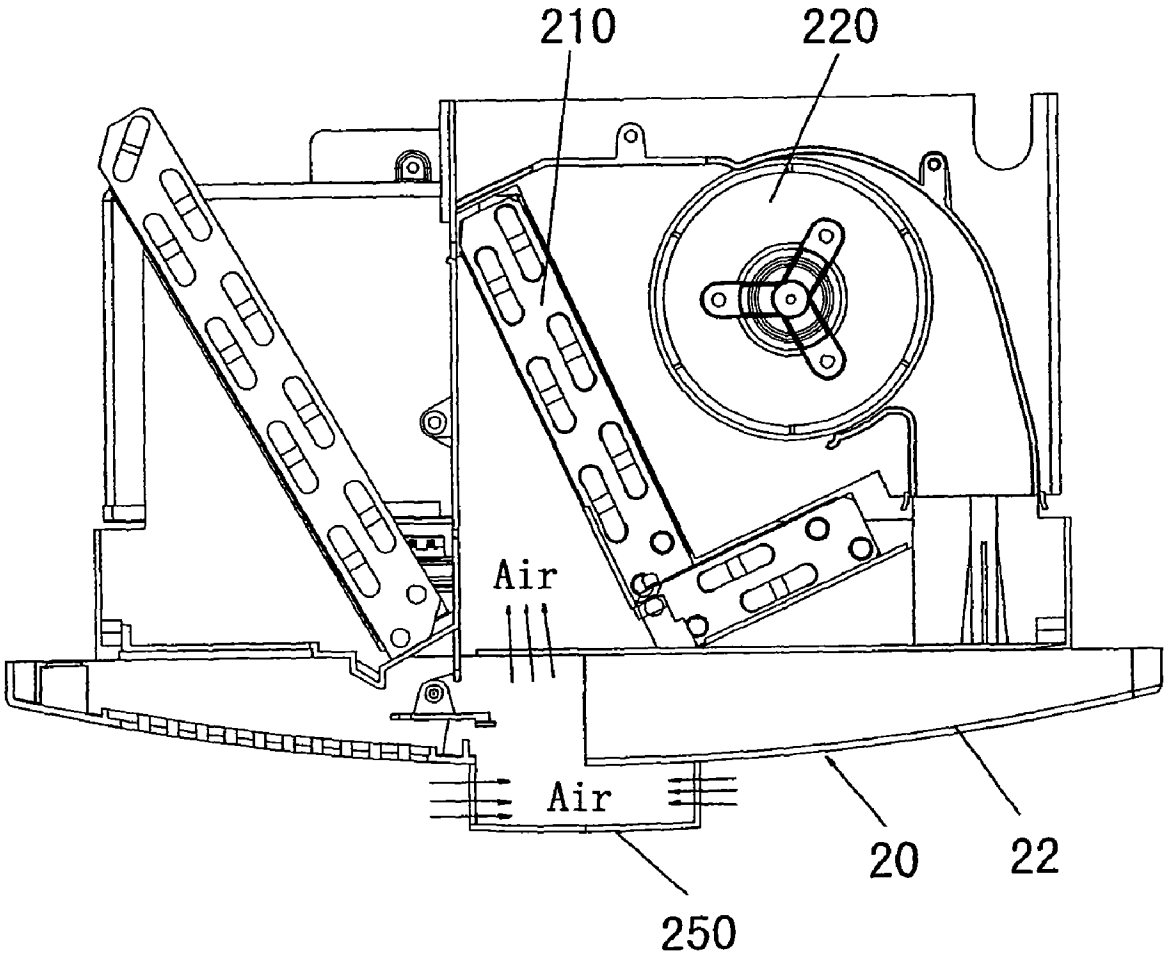
Figure 3C:
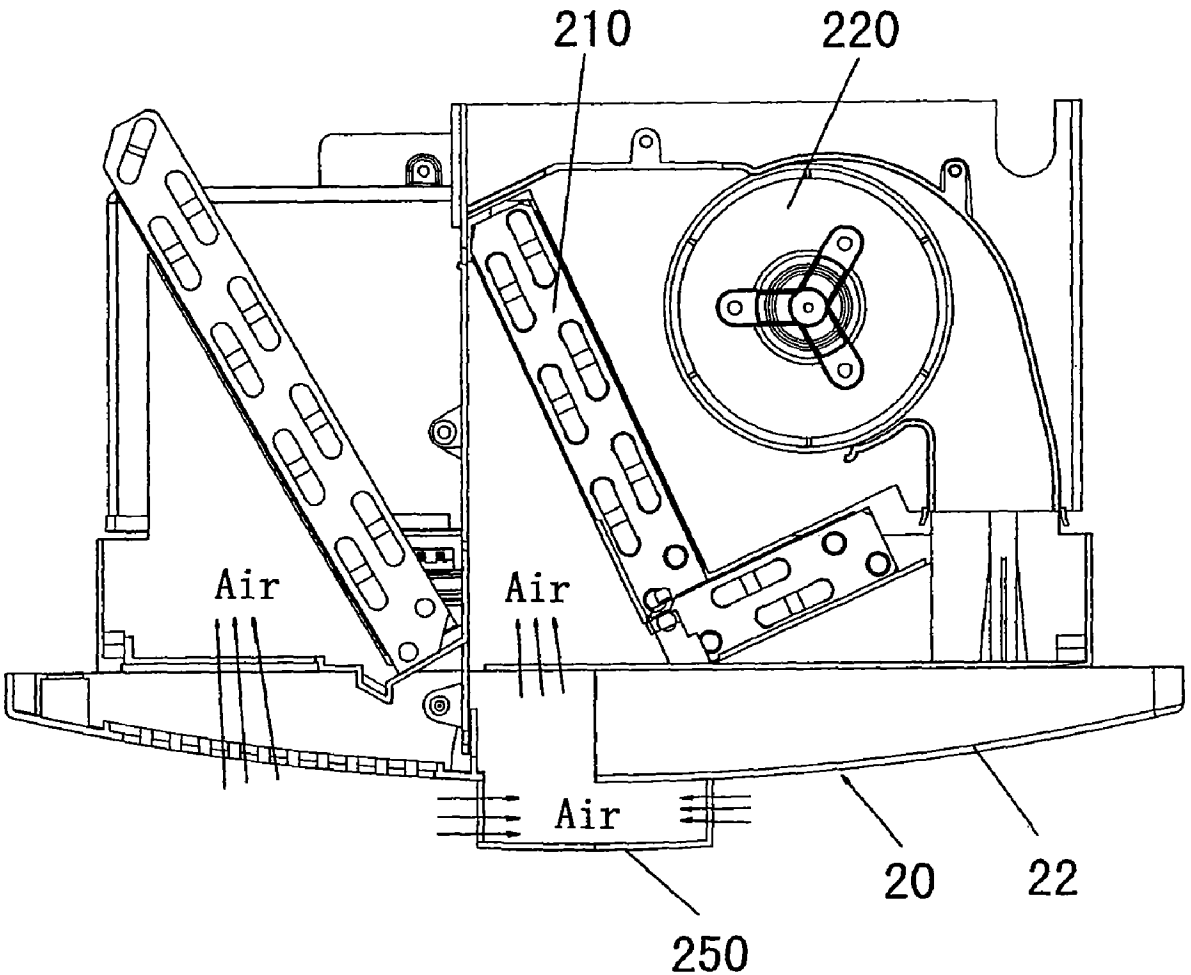

FIGS. 3A, 3B and 3C show schematic views of the second embodiment of the present invention. The second embodiment differs from the first embodiment in that it further comprises a second air inlet 250 in direct communication with the second area 200.

As shown in FIGS. 3A and 3B, because the second air inlet 250 is provided, the air amount entering into the second area is increased, and thus the air is blown out from the air outlet 22 of the panel 20 more effectively.

As shown in FIG. 3C, due to the second air inlet 250, if the circulating blower 220 is operated, the air is directed from the second air inlet 250 toward the condenser as the second heat exchanger 210. In this way, the dehumidifying, heating or cooling function can be performed at the same time when the ventilating blower (not shown) performs ventilating.

Figure 4:
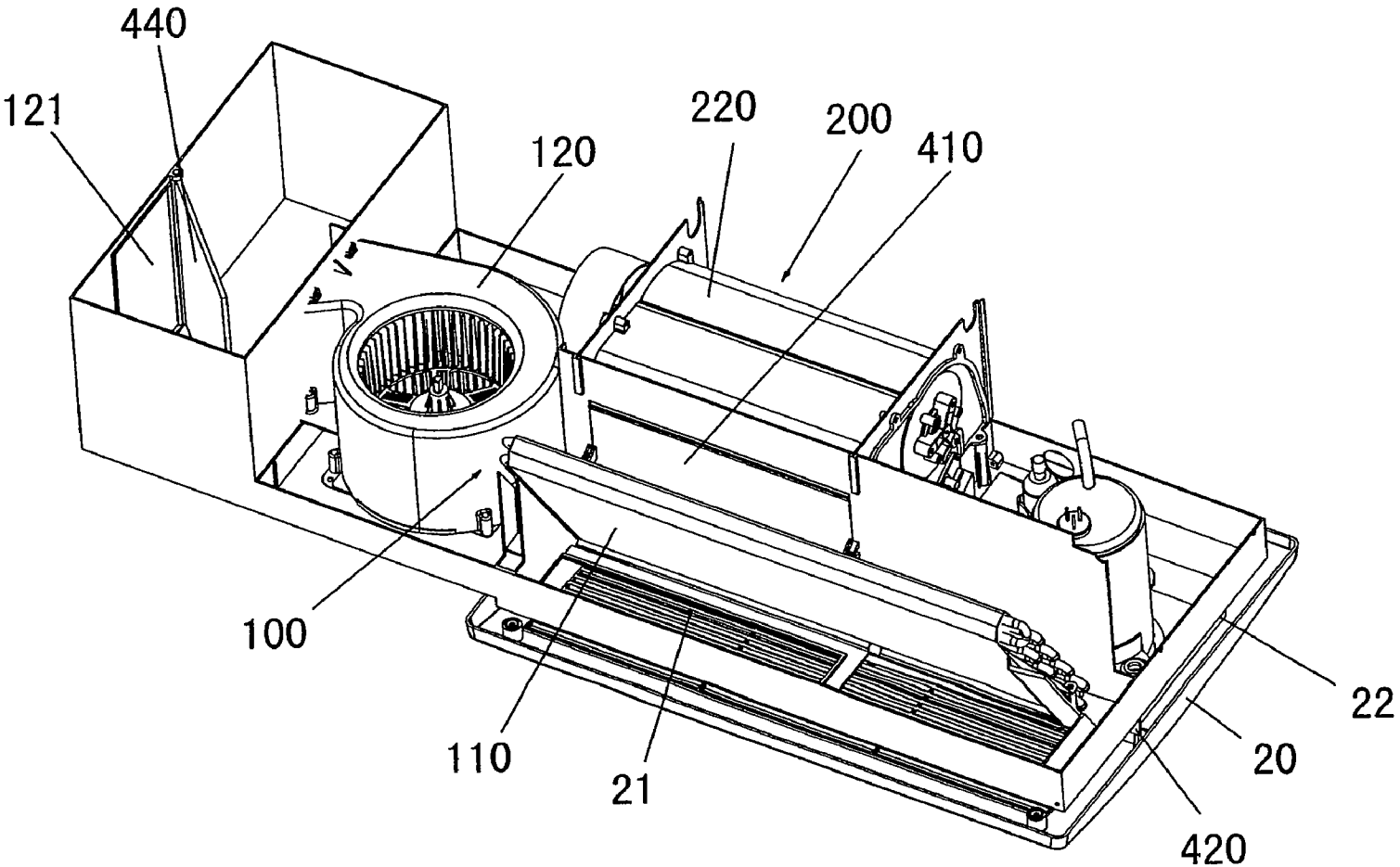
FIG. 4 is a schematic view of the third embodiment of the present invention.

FIG. 4 is a schematic view of the third embodiment of the present invention. The third embodiment differs from the first embodiment in that a second valve 440 is provided at the air outlet 121 of the ventilating blower 120. The second valve 440 can close the exhaust port 121 of the ventilating blower 120 communicated with the outdoor. In a state in which the exhaust port 121 is closed, and the first heat exchanger 110 is used as an evaporator and the second heat exchanger (not shown) 110 is used as a condenser, and the first plate 410 is opened and the second plate 420 is closed, when the circulating blower 220 is operated, the air introduced from the air inlet 21 of the panel 20 quickly passes through the first area 100 and then completely enters the second area 200, and then is blown out from the air outlet 22 of the panel 20. Since the closed second valve 440 blocks the backflow of the outdoor air, all the air processed by the two heat exchangers are the air introduced from the air inlet 21 of the panel 20. Therefore, the dehumidifying effect is much higher than in FIG. 2A.

Figure 5:
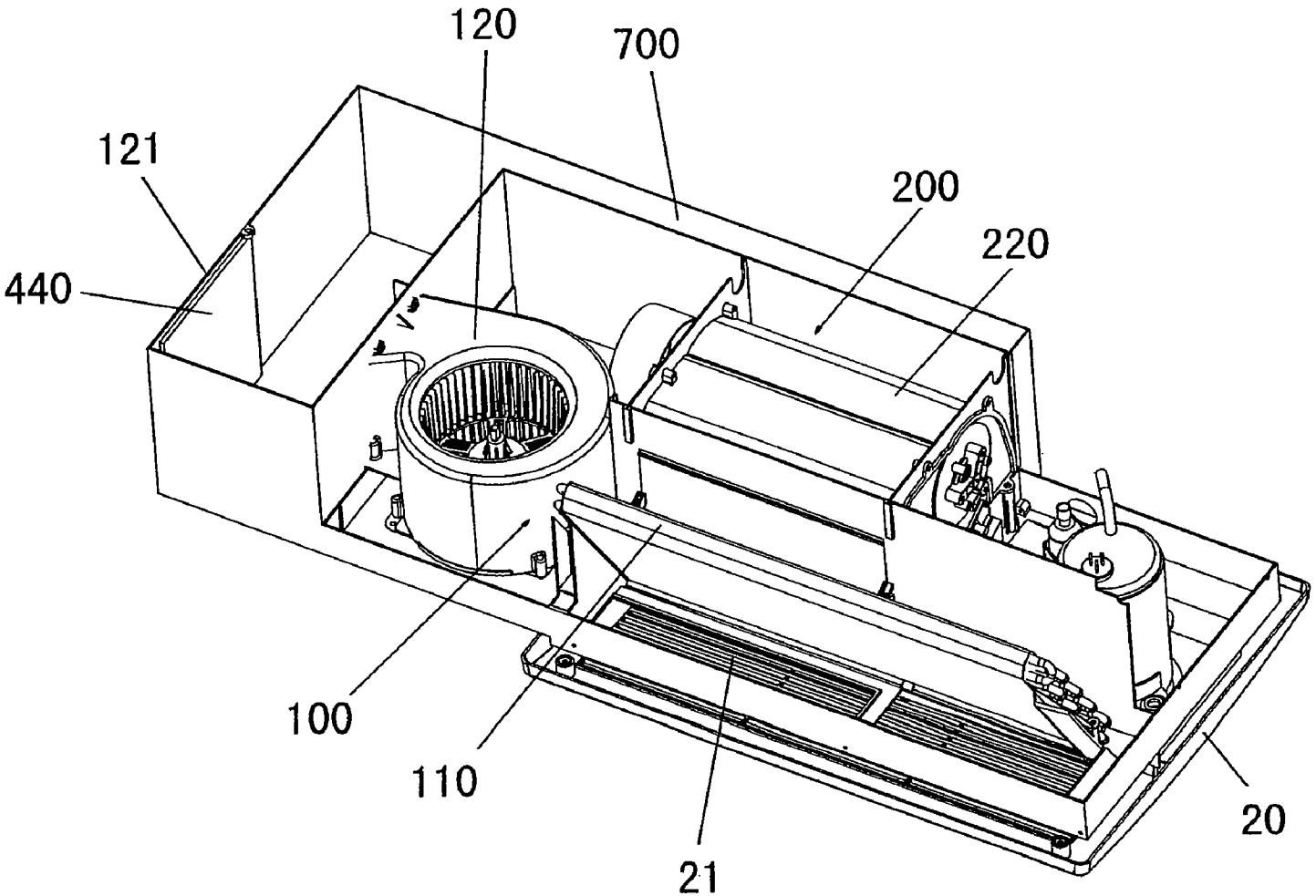
FIG. 5 is a schematic view of the fourth embodiment of the present invention.

FIG. 5 is a schematic view of the fourth embodiment of the present invention. The fourth embodiment of the present invention differs from the third embodiment in that it is provided with a fourth air path 700 for directing the air from the ventilating blower 120 towards the air outlet (not shown) of the panel 20. When the exhaust port 121 is closed, and the first heat exchanger 110 is used as an evaporator and the second heat exchanger (not shown) is used as a condenser, the ventilating blower 120 and the circulating blower 220 are opened simultaneously. Under the effect of the suction of the ventilating blower 120, the air introduced from the air inlet 21 of the panel 20 flows into the first heat exchanger 110 in the first area 100, where the moisture in the air is removed, and then the air is blown toward the room via the air outlet of the panel 20; under the effect of the suction of the circulating blower 220, the air introduced from the air inlet 21 of the panel 20 flows into the second heat exchanger (not shown) in the second area 200. At this time, the second heat exchanger functions to heat the air. The heated air is then blown toward the room via the air outlet (not shown) of the panel 20. The two blowers operate simultaneously, so the utilization factors of the heat exchanger and the compressor are high; the two kinds of air are mixed in the room, so that the dehumidifying effect can be improved.

Figure 6A:
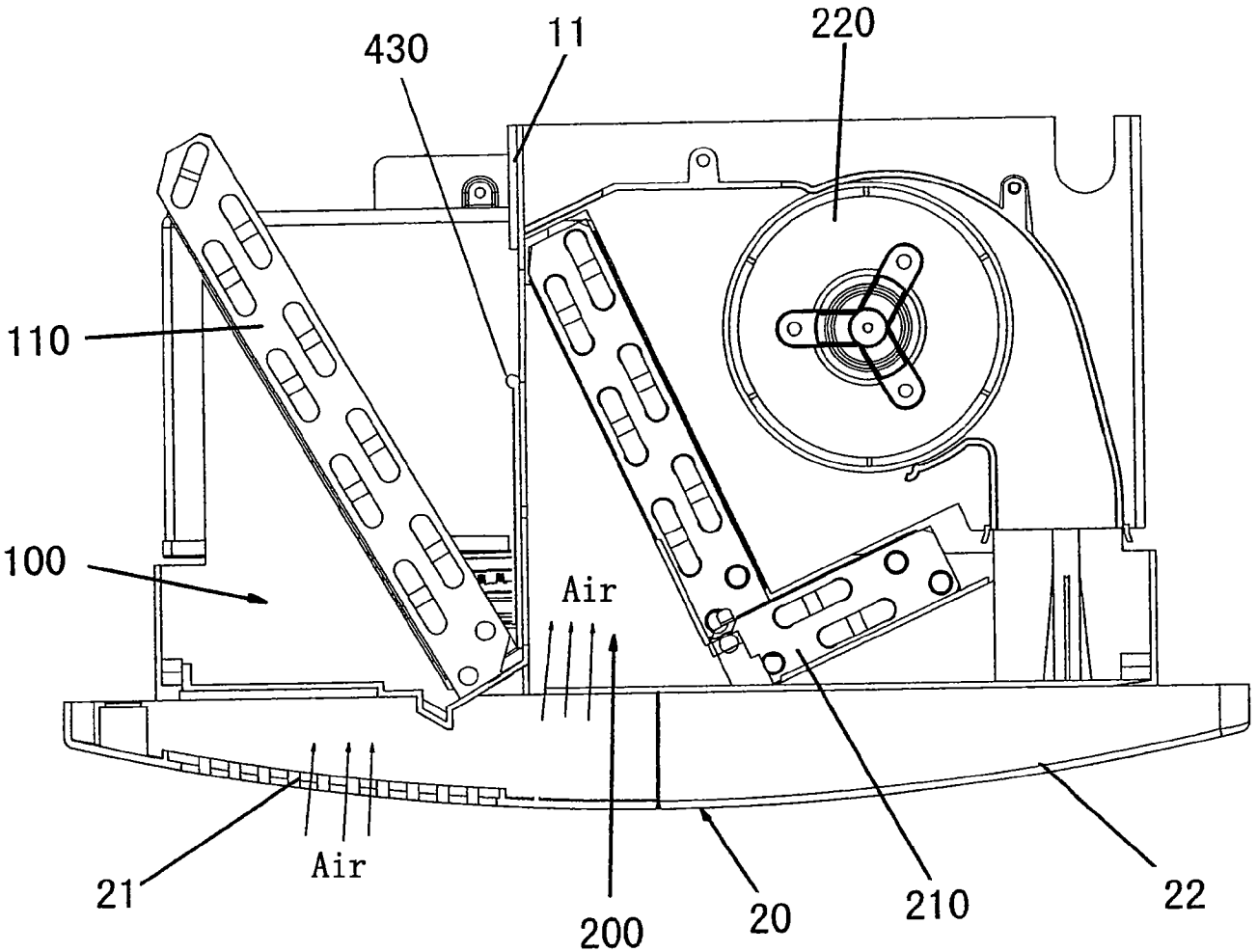
FIGS. 6A and 6B are schematic views of the fifth embodiment of the present invention.
Figure 6B:
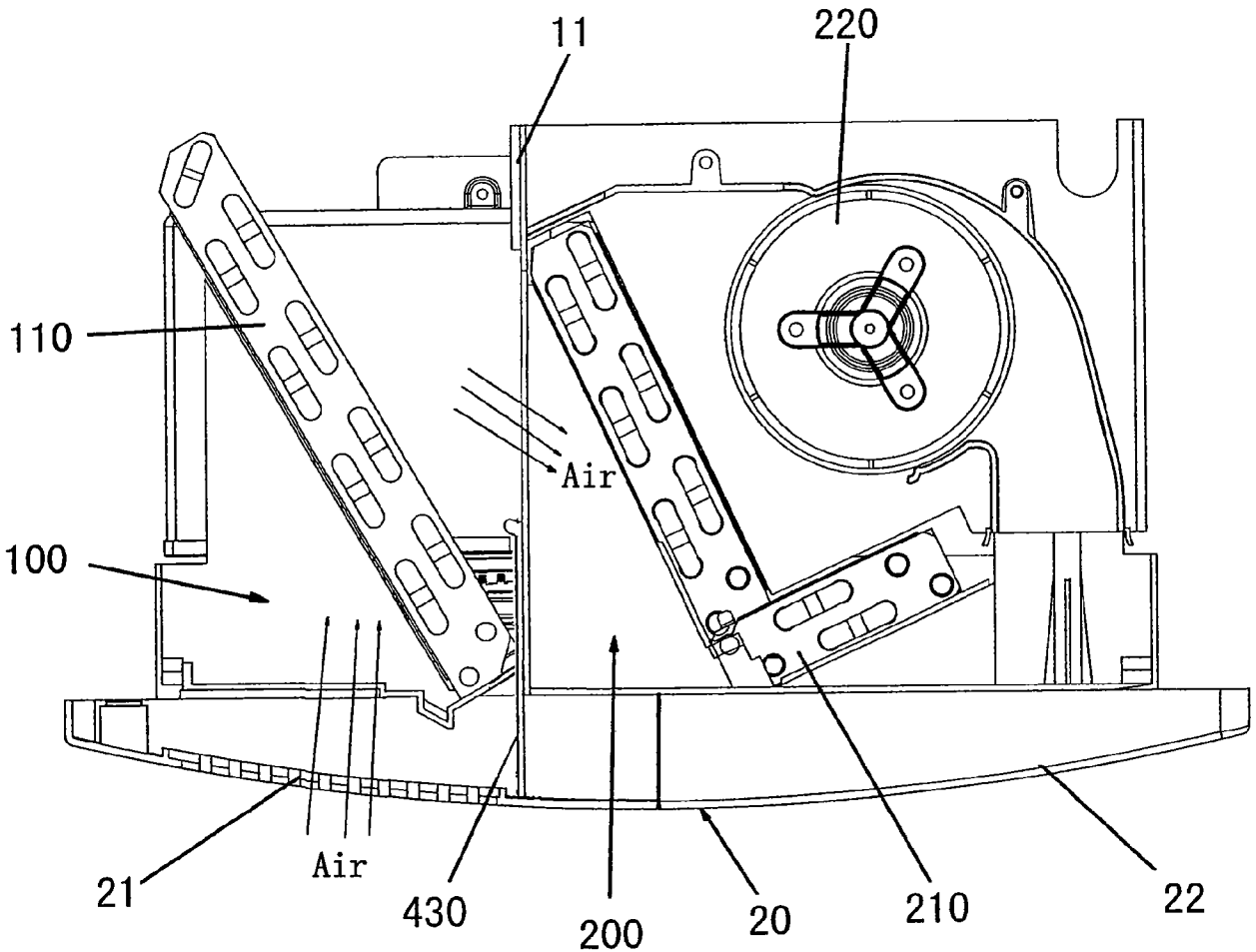

FIGS. 6A and 6B show schematic view of the fifth embodiment of the present invention. The fifth embodiment differs from the first embodiment in that one plate in the fourth embodiment is used to replace the two plates in the first embodiment. In the present embodiment, a third plate 430 is provided to slide up and down on the partition plate 11 between the first area 100 and the second area 200.

As shown in FIG. 6A, the third plate 430 is in a state after sliding upwardly. The first area 100 is isolated from the second air path. The air inlet 21 of the panel 20 and the second area 200 form a communicated air path. When the circulating blower 220 is operated, the air is introduced from the air inlet 21 of the panel 20. At this time, the air passes through the second heat exchanger 210 directly without passing through the first heat exchanger. At this time, if the ventilating blower (not shown in the figure) is also operated, the air enters the first area 100 from the air inlet 21 of the panel 20, passes through the first heat exchanger 110, and then is discharged to the outdoor by the exhaust port (not shown) of the ventilating blower (not shown) in communication with the outdoor. This forms the first communicated air path and realizes the ventilating function. If at this time, the first heat exchanger is used as an evaporator and the second heat exchanger is used as a condenser, the air is heated and then blown out from the air outlet 22 of the panel to realize the heating function. Alternatively, if at this time, the first heat exchanger is used as a condenser and the second heat exchanger is used as an evaporator, the air is cooled and the cold air is blown out from the air outlet 22 of the panel to realize the cooling function. On the other hand, if at this time, the circulating blower 220 is turned off and the ventilating blower (not shown) is turned on, the air is introduced from the air inlet 21 of the panel 20, and then is discharged to the outdoor via the exhaust port 121 of the ventilating blower (not shown) and thus only the ventilating function is realized.

As shown in FIG. 6B, the third plate 430 is in a state after sliding downwardly. The air inlet 21 of the panel 20, the first area 100 and the second area 200 form a communicated air path. When the circulating blower 220 is operated on condition that the first heat exchanger 110 is used an evaporator and the second heat exchanger 210 is used as a condenser, the air is introduced from the air inlet 21 of the panel 20, and then the air firstly passes through the evaporator as the first heat exchanger 110, by which the moisture in the air is condensed into liquid and extracted, and then the air passes through the condenser as the heat exchanger 210. After that, the air is blown out from the air outlet 22 of the panel 20. This forms the second communicated air path. At this time, the air is dehumidified air and the dehumidifying function is realized. If at this time, the circulating blower is tuned off and the ventilating blower (not shown) is turned on, the air is introduced from the air inlet 21 and the air outlet 22 of the panel 20, and then is discharged to the outdoor via the exhaust port 121 of the ventilating blower (not shown) and thus the ventilating function is realized.

Although the embodiments of the present invention have been described and illustrated above, it will be appreciated by those skilled in the art that the different embodiments can be combined and the embodiments can be further modified and changed in various ways without departing from the scope of the claims.

What is claimed is:

1. A multifunctional ventilating fan, comprising a machine body, a panel provided with an air inlet and an air outlet, wherein the machine body includes a first area, a second area, and a third area separated by several partition plates; and wherein the first area is provided therein with a first heat exchanger and a ventilating blower, an exhaust port of the ventilating blower is communicated with the outdoor; the second area is provided therein with a second heat exchanger and a circulating blower; the third area is provided with therein a compressor; the air inlet of the panel is communicated with the first area to form a first air path; the air inlet of the panel, the first area, the second area and the air outlet of the panel are communicated in turn to form a second air path; a first valve is provided in the second air path for isolating the first area so that a third air path is formed by the air inlet of the panel, the second area and the air outlet of the panel communicated in turn.

2. The multifunctional ventilating fan according to claim 1, wherein the panel with the air inlet and air outlet is mounted at a lower side or a lateral side of the machine body.

3. The multifunctional ventilating fan according to claim 1, wherein a second valve is provided at an exhaust port of the ventilating blower for blocking up the communication between the ventilating blower and the outdoor.

4. The multifunctional ventilating fan according to claim 1, wherein a second valve is provided at the exhaust port of the ventilating blower for blocking up the communication between the ventilating blower and the outdoor so that the air from the ventilating blower is guided towards the air outlet of the panel to form a fourth air path.

5. The multifunctional ventilating fan according to claim 1, wherein the first valve consists of a first plate and a second plate which are openable or closable, wherein the first plate is positioned between the first heat exchanger and the second heat exchanger for blocking the air from the first heat exchanger from entering the second area when it is closed, and for allowing the air from the first heat exchanger to enter the second area when it is opened; the second plate is positioned between the first heat exchanger and the panel for blocking the air from the air inlet of the panel from directly entering the second area when it is closed, and for allowing the air from the air inlet of the panel from directly entering the second area when it is opened.

6. The multifunctional ventilating fan according to claim 1, wherein the first valve is a third plate sliding up and down along the partition plate between the first area and the second area; when the third plate slides upwardly, the air inlet of the panel, the second area and the air outlet of the panel are communicated to form the third air path; at the same time, the air inlet of the panel, the first area and the exhaust port of the ventilating blower are communicated to form the first air path; when the third plate slides downwardly, the air inlet, the first area, the second area and the air outlet of the panel are communicated to form a second air path.

7. The multifunctional ventilating fan according to claim 1, wherein the first heat exchanger is obliquely positioned in the first area with respect to the panel.

8. The multifunctional ventilating fan according to claim 1, wherein the first heat exchanger is perpendicularly positioned on the diagonal line of the first area with respect to the panel.

9. The multifunctional ventilating fan according to claim 1, wherein the panel is provided with a second air inlet directly communicated with the second area.

10. The multifunctional ventilating fan according to claim 1, wherein a scroll of the ventilating blower is positioned perpendicularly or transversely with respect to the panel.

11. The multifunctional ventilating fan according to claim 1, wherein the blades of the ventilating blower are multi-wing blades.

12. The multifunctional ventilating fan according to claim 1, wherein the circulating blower has cross flow blades or multi-wing blades.

* * * * *